United States Patent [19]

Coleman

[11] 4,030,261

[45] June 21, 1977

[54] CERAMIC CAP FOR INSULATION ANCHOR

[75] Inventor: Bob G. Coleman, Augusta, Ga.

[73] Assignee: The Babcock & Wilcox Company, New York, N.Y.

[22] Filed: Apr. 8, 1975

[21] Appl. No.: 566,644

[52] U.S. Cl. ..... 52/511; 52/362; 52/410; 52/506; 52/704; 85/8.6; 85/23; 85/35

[51] Int. Cl.[2] ..... E04B 1/40

[58] Field of Search ..... 52/410, 404, 506, 511, 52/582, 704, 705, 570, 145, 361, 362, 363; 85/8.6, 23, 35, 66

[56] References Cited

UNITED STATES PATENTS

| | | | |
|---|---|---|---|
| 2,021,610 | 11/1935 | Quint | 52/513 X |
| 2,092,341 | 9/1937 | De Vries | 85/66 |
| 2,256,961 | 9/1941 | Pearson et al. | 52/410 |
| 2,389,965 | 11/1945 | Eckel | 52/508 |
| 2,412,744 | 12/1946 | Nelson | 52/410 |
| 2,452,173 | 10/1948 | Zwiebel | 85/35 |
| 3,356,401 | 12/1967 | Bertram | 85/35 X |
| 3,434,521 | 3/1969 | Flora | 85/35 X |
| 3,523,395 | 8/1970 | Rutter et al. | 52/410 |
| 3,687,093 | 8/1972 | Byrd, Jr. | 52/506 X |
| 3,738,217 | 6/1973 | Walker | 85/8.6 |
| 3,742,670 | 7/1973 | Byrd | 52/410 |
| 3,829,150 | 8/1974 | Moore | 85/35 |

*Primary Examiner*—Leslie A. Braun
*Attorney, Agent, or Firm*—Joseph M. Maguire; Vincent M. Fazzari; Albert P. Cefalo

[57] ABSTRACT

A pre-burned ceramic cap cooperating with a notched metallic stud to anchor ceramic fiber insulating material in the interior wall of a furnace. The cap is provided with a slotted collar internally of the cap, so that on rotation of the cap surfaces on the collar engage surfaces on a notch to lock the assembly in position and to protect the metallic parts of the assembly from the deteriorating effects of combustion gas contact therewith.

7 Claims, 3 Drawing Figures

CERAMIC CAP FOR INSULATION ANCHOR

The present invention relates to an anchor assembly to support heat insulating materials in the interior walls of a furnace, and more particularly to a support structure for insulating materials, including at least a layer of fibrous materials positioned on the interior walls of a furnace or duct exposed to high temperature gases.

The walls of furnaces and hot gas ducts are frequently lined by ceramic heat insulating panels which may be formed of blocks and/or fibrous materials. Many systems of suppport for such panels have been developed and used to anchor the panels to the supporting structure of the furnace or duct. The type or kind of support selected to anchor the heat insulating material is largely determined by the costs (including installation) and the service required in operation. Service factors involved include the environment within the furnace or duct such as the temperatures, and the corrosive or erosive character of the gases.

A very effective, inexpensive type of anchor support is disclosed in U.S. Pat. No. 3738217. In this patent a rectangular cross section, notched stud is welded to a metallic part of a furnace wall or part of the structural support. The insulating material is impaled on the stud with the end of the stud extending beyond the insulating material with a clip attached to the inner end of the stud to retain the insulating material on the stud support. In such construction the exposed end of the stud and the clip is exposed to the environment of the gas in the furnace or the duct confining the gas. When the gases are at relatively high temperatures, such as in fuel combustion, temperatures of 2300°–3000° F are encountered and the gases usually contain small amounts of oxygen, the life of metallic parts is extremely limited, even though expensive alloys such as stainless steel and the like are used. Many gases contain corrosive materials or condensation products which will attack metallic parts at many of the temperatures encountered in insulated ducts or furnaces. In many installations the combination of one or more conditions of temperature, corrosion or erosion require at least the part of the insulation anchor exposed to such gases to be formed of ceramic refractory material to provide reasonable service life to the installation.

In accordance with the invention the clip and that portion of the anchor support exposed to direct contact with gases of combustion is made of a ceramic refractory material forming a cap. Such a ceramic cap is formed with a tubular elongated or shank portion open and inwardly tapered at one end and having its opposite end formed with and enclosed by a refractory flange. The inner wall of the open ended tubular portion is formed with an inwardly extended ceramic collar having a slotted opening therein. The ceramic cap cooperates with a metallic stud of rectangular cross section having a plurality of spaced notches formed on the end thereof to pass through the slotted end of the ceramic cap to be locked thereon by rotation of the cap with respect to the stud. Of the drawings:

Figure 1:
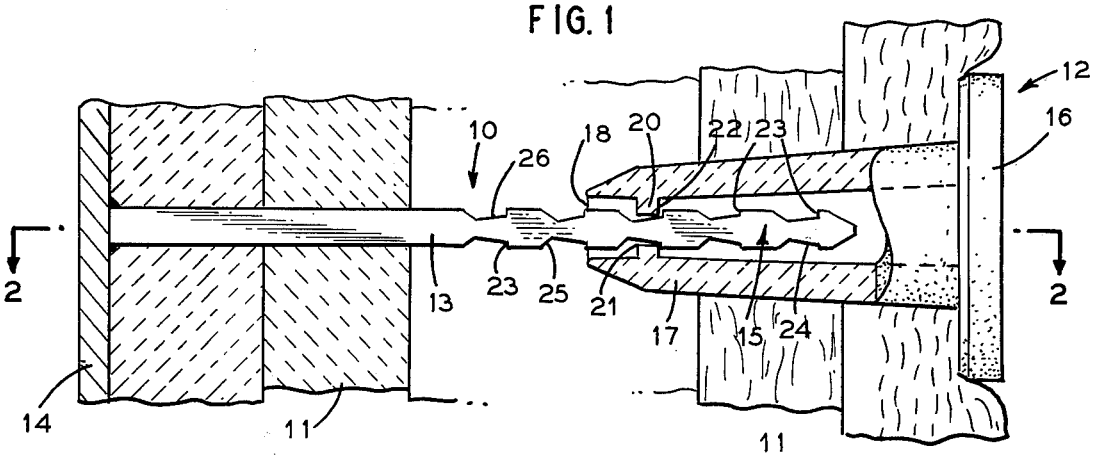
FIG. 1 is a partial cross-section of the ceramic cap of the invention locked in position on a notched metallic stud to support a layer of fibrous ceramic insulating material.
Figure 2:
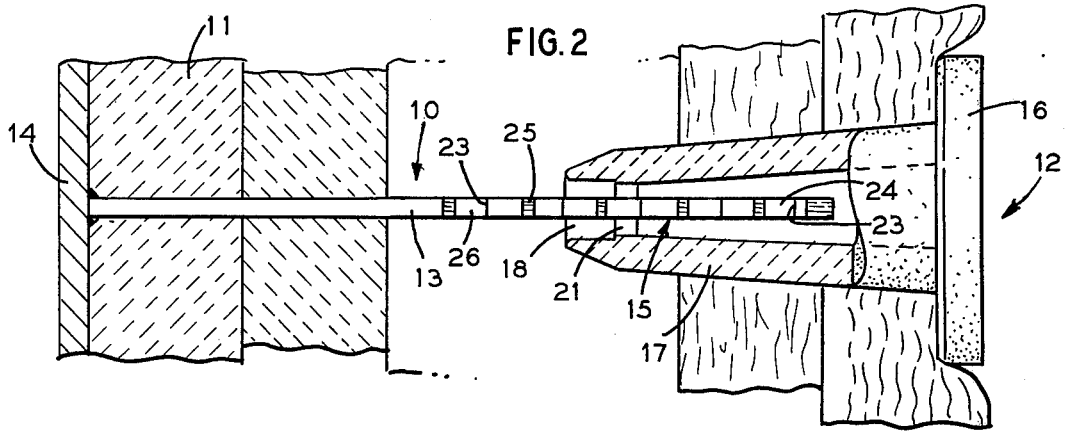
FIG. 2 is a partial cross-section of the structure taken along line 2—2 of FIG. 1.

In the embodiment of the invention shown in FIGS. 1 and 2, a support or anchor assembly 10 is illustrated as utilized in supporting multiple blanket layers of fibrous insulating material 11. As shown, a cap 12 is fixed on the end of a metallic stud 13 which in turn is welded to the metallic wall 14 of a furnace or duct to form the assembly 10. In the ordinary furnace or duct arrangement the thickness of the insulation may vary between fairly wide limits depending upon the insulation required. As shown, the thickness of the insulation is approximately 6 inches. In the usual situation the insulation is supplied as fiber blankets of for example 1 inch thickness and a great variety of length and width of blanket so that the insulation can be cut to fit the configuration of the supporting walls. In the usual situation the blanket density may vary from 8 to 20 lbs. per sq. ft. where the density influences the insulation effect of the blanket. In a 6 inches deep insulating structure six layers of 1 inch thick blanket may be used although other standard thicknesses are available, as for example 2. inches.

It will be understood that in some situations a layer of solid insulating material, such as a panel may be used in combination with layers of fibrous insulating material. As a further example there may be occasions when a solid insulating panel might be installed adjacent to the wall 14 of the furnace or the duct while on other occasions the solid panel may be positioned on the interior wall of the insulating structure. When such solid panels are used it is desirable to perforate the panel to accommodate either the cap 12 or the stud 13 as the location of the panel may require. It will be further understood that under certain furnace environmental conditions a fiber blanket will not as successfully withstand the erosive and/or coorosive conditions of the gases as well as a solid panel. In any event there must be sufficient layers of fibrous material in the over-all assembly of insulating material to permit the insertion of the anchor assembly to provide the necessary resiliance to lock the stud 13 and the cap 12 together, as hereinafter more completely described.

As shown more particularly in FIGS. 1 and 2 it will be noted the end portion 15 of the stud 13 is enclosed by the refractory structure of the cap 12, and since the ceramic cap 12 has a solid end or flange portion 16 the metallic portion 15 of the stud 13 is not directly exposed to contact with the gases confined by the wall of the furnace or duct. After the assembly 10 is locked in position, as hereinafter described, the assembly will retain its positioned relationship and anchor the insulating materials 11 to the wall 14 of the furnace or duct. It will also be recognized that upon need, where replacement of insulating material 11 becomes necessary, the ceramic cap 12 may be unlocked, or under certain conditions may be broken, to permit replacement of the insulating materials.

Figure 3:
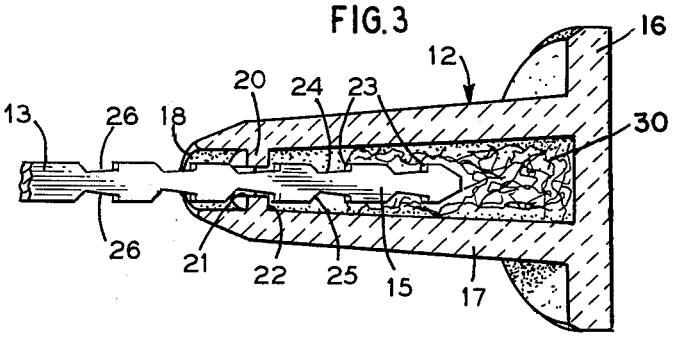
FIG. 3 is a perspective cross-section of the ceramic cap shown in FIGS. 1 & 2.

The ceramic cap 12 of the invention is disclosed in FIGS. 1, 2, and 3. In FIG. 3, which is a perspective cross section showing the construction of the cap the cap is shown as formed of fired ceramic refractory material shaped with a base portion 16 of generally flange form which is solid. The shank 17 of the cap 12 is formed as a frustoconical hollow member which is open at its smaller end 18 and provided with an internal collar 20 with a slotted opening 21 therethrough. The slotted opening 21 of the collar 20 is rectangular in shape having slightly greater dimensions than the external rectangular dimensions of the stud 13.

In the assembly of the cap on the stud the conical shape of the shank 17 permits the cap to be pushed into and through the fibrous insulating blanket onto the stud 13 and due to the resiliancy of the blanket insulating material 11 when the cap is locked on the stud by a 90° rotation thereof the inner surface 22 of the collar 20 engages a surface 23 in a notch 24 in the end portion 15 of the stud 13 and the resiliancy of the blanket forces the assembly 10 outwardly to engage the surface 23 shoulder of the notch 24 with the surface 22 of the collar of the locking arrangement.

In the embodiment shown the stud is approximately 5 inches long with 5 notches 24 formed in the end porton 15 thereof. The length of the stud 13 may be greater or less than that shown, but the overall length of the stud will necessarily be less than the normal thickness of the insulating material so that when the cap 12 is installed the end of the stud will not be exposed to the gases within the furnace or duct. Each of the notches 24 is symetrically formed in pairs on opposite sides of the stud 13 and is approximately one-fourth inch in length with the successive surfaces 23 being about one-half inch apart. With a surface 23 in each notch being substantially normal to the axis of the stud 13 the opposite surface 25 of the notch will be conveniently rounded or tapered to retain an inner surface 26 which is substantially parallel to the axis of the stud 13. For strength purposes the body of the stud 13 between notch surfaces 26 on opposite sides of the stud will be of approximately the same thickness as the minor dimension of the stud. The stud is generally about ¼ inch in its major cross-sectional dimension and approximately 3/32 inch in its minor dimension. The cap 12 is approximately 3 inches long and the slot 21 formed in the collar 20 will be slightly greater than the ¼ × 3/32 inch dimensions of the stud 13 so that the cap, relative to the stud, will engage the surfaces 23 of one of the notch pairs 24 against the inner surface 22 of the refractory collar. The engagement between the two surfaces in locked position is maintained by the fiber blanket which is compressed on insertion of the cap.

It will be understood it is sometimes desirable to insert some plastic filler material such as mortar in the open end of the cap 12 immediately prior to insertion of the cap 12 on the stud 13. Thus, when the positional relationship of the cap and the stud lock the two together the hardening of the material or mortar will tend to strengthen the locked position of the combination when the material has dried. Such a procedure is sometimes desirable when the assembly is subject to vibration. It will of course be understood that the resiliancy of the fiber blankets may deteriorate when such fiber blankets are exposed to prolonged periods of high temperature service. Under these conditions even slight vibration in the wall structure may tend to cause rotation of the cap 12 relative to the stud 13 to unlock the preferred relative positions of the installed assembly. The hardened material or mortar will be of some aid in maintaining the relationship of the parts under these conditions.

Under conditions of high temperature service, the heat conductance through the ceramic cap 16 by either radiation or conductance, or both, may suggest the desirability of inserting a plug of insulating material such as ceramic fibers 30 in the interior space between the collar 20 and the flange 16 to further protect the end 15 of the stud 13. Such a plug of fiber may be inserted during the manufacture of the cap, or after the ceramic material of the cap has been heated or "burned" in the manufacturing procedure.

What is claimed is:

1. An anchor for fiber insulation of a furnace comprising an elongate metallic stud of rectangular cross-section affixed at one end to a furnace wall, the stud having a plurality of notches cut in an opposite end portion thereof, insulating material lining the interior of the furnace and including at least some thickness of resilient ceramic fiber blanket, the length of the stud being less than the thickness of insulating materials lining the furnace, a tubular ceramic cap open and inwardly tapering at one end and having its opposite end enclosed and integrally formed with a refractory flange, the inner wall of the cap being formed with an inwardly extending ceramic collar provided with a slot-like opening of a configuration corresponding to and slightly larger than the cross section of the stud to engage the notches in the stud within the furnace lining and to retain the insulating materials on the wall, whereby the resiliency of the insulating materials forces the cap into the locking engagement with the notches.

2. An anchor according to claim 1 wherein the notches in the end portion of the metallic stud are formed in pairs on opposite sides of the stud, and each notch has a surface substantially normal to the longitudinal axis of the stud.

3. An anchor according to claim 2 wherein the collar in the ceramic cap has a thickness less than the longitudinal dimension of a notch, and an inner surface of the collar is normal to the longitudinal axis of the cap.

4. An anchor according to claim 3 wherein the surface of the notch engages the inner surface of the collar in locking relationship upon rotation of the cap.

5. An anchor according to claim 1 wherein an inner portion of the cap between the collar and the flange is provided with a plug of ceramic fiber material for heat insulating purposes.

6. A one-piece, unitary anchor for ceramic fiber comprising a tapered tubular refractory device open at one end and having its opposite end integrally enclosed and formed with an outwardly extending refractory flange, the inner wall adjacent the open end of the device being formed with an inwardly extending ceramic collar providing a slot-like opening.

7. An anchor according to claim 6 wherein the tubular refractory device is inwardly tapered at said open end.

* * * * *